US007370570B2

(12) United States Patent
Nakata et al.

(10) Patent No.: US 7,370,570 B2
(45) Date of Patent: May 13, 2008

(54) FLUID PRESSURE CYLINDER

(75) Inventors: Akio Nakata, Tokyo (JP); Masakazu Tetsuka, Tokyo (JP)

(73) Assignee: Koganei Corporation, Tokyo (JP)

( * ) Notice: Subject to any disclaimer, the term of this patent is extended or adjusted under 35 U.S.C. 154(b) by 48 days.

(21) Appl. No.: 10/593,839

(22) PCT Filed: Mar. 9, 2005

(86) PCT No.: PCT/JP2005/004065

§ 371 (c)(1),
(2), (4) Date: Sep. 22, 2006

(87) PCT Pub. No.: WO2005/090796

PCT Pub. Date: Sep. 29, 2005

(65) Prior Publication Data

US 2007/0199441 A1 Aug. 30, 2007

(30) Foreign Application Priority Data

Mar. 24, 2004 (JP) ..... 2004-086656

(51) Int. Cl.
*F15B 15/26* (2006.01)
*B25J 18/02* (2006.01)

(52) U.S. Cl. ..... 91/43; 92/27; 92/28; 92/29

(58) Field of Classification Search ..... 91/41, 91/43; 92/15, 24, 27, 28, 29
See application file for complete search history.

(56) References Cited

U.S. PATENT DOCUMENTS 4,564,088 A * 1/1986 Takahashi et al. ..... 92/29
5,365,828 A * 11/1994 Sperber et al. ..... 91/41
5,522,303 A * 6/1996 Stoll et al. ..... 92/27
6,009,981 A * 1/2000 Wolfe ..... 188/267
6,474,899 B1 * 11/2002 Corradi ..... 403/322.1
6,511,255 B1 * 1/2003 Mainardi ..... 403/365

FOREIGN PATENT DOCUMENTS

| | | |
|---|---|---|
| JP | 45-6579 | 3/1970 |
| JP | 49-63396 | 6/1974 |
| JP | 59-155306 | 10/1984 |
| JP | 60-167215 | 11/1985 |
| JP | 62-42938 | 3/1987 |
| JP | 63-254208 | 10/1988 |

(Continued)

*Primary Examiner*—Thomas E. Lazo
(74) *Attorney, Agent, or Firm*—McCormick, Paulding & Huber LLP

(57) ABSTRACT

A fluid pressure cylinder can apply a fastening force to an axially movable reciprocating rod. A reciprocating rod 13 is mounted in a case main body 10 so as to be reciprocable in a forward direction and a backward direction, and two lock units 16*a* and 16*b* are incorporated in the case main body 10, and the lock units 16*a* and 16*b* include: lock sleeves 18*a* and 18*b* mounted axially movably and having taper surfaces 22*a* and 22*b*; and retainers 19*a* and 19*b* holding steel balls 21*a* and 21*b* that are fitted in the reciprocating rod 13 axially movably and engaged with the taper surfaces. A fastening cylinder 41 that contains a fastening rod so as to be reciprocable in a fastening direction and a fastening release direction is attached to the case main body 10, a fastening surface 44 contacting with the lock sleeves 18*a* and 18*b* being formed in the fastening rod, and the reciprocating rod 13 is fastened by the two lock units 16*a* and 16*b*.

7 Claims, 7 Drawing Sheets

FOREIGN PATENT DOCUMENTS

| | | |
|---|---|---|
| JP | 64-030906 | 2/1989 |
| JP | 1-38353 | 11/1989 |
| JP | 11-013714 | 1/1999 |
| JP | 2003-202004 | 7/2003 |
| JP | 2004-011685 | 1/2004 |
| JP | 2004-301310 | 10/2004 |

* cited by examiner

FLUID PRESSURE CYLINDER

TECHNICAL FIELD

The present invention relates to a fluid pressure cylinder for rod fastening so as to apply fastening power to a reciprocating rod to be reciprocable axially.

BACKGROUND ART

In production lines for assembling a plurality of parts and producing industrial products, there is a work operation of taking out one part, i.e., one workpiece at a time by an industrial robot from a workpiece containing unit in which a number of parts are accommodated and then of assembling it to into a product. For example, when assembling a vehicle body, the vehicle body is produced by jointing a plurality of panel materials using a spot welding method or the like, i.e., the panel materials are assembled into the vehicle body by vacuum-holding the panel materials using a vacuum-sucking pad mounted on a robot arm and by transferring them to the vehicle body from the workpiece containing unit. When the robot arm is operated and the panel material, i.e., the workpiece is vacuum-held by the vacuum-sucking pad, vacuum is supplied to the vacuum-sucking pad under a state where the vacuum-sucking pad applies a predetermined pressing force to the workpiece. For this reason, it becomes necessary to apply the pressing force to the vacuum-sucking pad by the robot arm. In order to exert this pressing force on the vacuum-sucking pad, the vacuum-sucking pad is attached to a reciprocating rod driven by a fluid pressure cylinder and when the vacuum-held workpiece is to be transferred by the robot arm, it becomes necessary to fix the reciprocating rod in order to prevent the workpiece from swinging.

Further, when the vehicle body is assembled, as described in Patent Document 1, spot welding may be performed under a state where fastening between workpieces is carried out by a clamp arm, or the workpiece may be transferred by a carrying truck under a state where the workpiece is fastened by the clamp arm. In the case where the clamp arm is opened/closed by the reciprocating rod of the fluid pressure cylinder, it is necessary to fix the reciprocating rod for opening/closing the clamp arm in order to hold a clamped state for a predetermined period of time.

Patent Document 1: Japanese Patent Laid-Open Publication No. 2003-202004

DISCLOSURE OF THE INVENTION

When the workpiece is vacuum-held and transferred by the robot arm, not only there is restriction to positioning precision of the vacuum-sucking pad by an operation of the robot arm but also a position of the panel material in the workpiece containing unit changes and an assembling position of the material to the vehicle body changes accordingly. Therefore, it is necessary to mount the vacuum-sucking pad on the axially movable reciprocating rod and to make the vacuum-sucking pad movable. However, when the workpiece is to be transferred toward its assembly position by the robot arm, it is required to fix the reciprocating rod so that the workpiece is not moved. In the case where a braking force is applied to the reciprocating rod having thus been movable axially to keep the reciprocating rod in a fixed state, a cylinder with brake is employed. If the reciprocating rod is fixed by only air pressure, the cylinder with brake becomes large in size, whereby there is a problem of being unsuited for attachment of the cylinder with brake to a moving member such as the robot arm.

Meanwhile, as described above, in the case where the workpiece is transferred under a state where the clamp arm is loaded on the workpiece carrying truck and clamps the workpiece, because fluid pressure cannot be supplied from the outside to the carrying truck during transfer, it is necessary to hold a clamping force even under a state where pressure supply to the fluid pressure cylinder is stopped. In any case, in order to improve assembly workability of the workpiece, it is preferred to be capable of applying a predetermined fastening force to the reciprocating rod by the small fluid pressure cylinder.

Accordingly, an object of the present invention is to provide a fluid pressure cylinder wherein a reciprocating rod that is driven axially by fluid pressure can be fixed at any position.

Another object of the present invention is to provide a fluid pressure cylinder wherein the reciprocating rod can be certainly fixed even if an external force is exerted on the reciprocating rod in either of forward and backward directions under a state where the reciprocating rod driven axially by the fluid pressure is fixed.

A fluid pressure cylinder according to the present invention comprises: a case main body in which a reciprocating rod is mounted so as to be reciprocable in a forward direction and a backward direction; a first lock unit including a first lock sleeve with a taper surface whose diameter is large toward a tip portion of the reciprocating rod, the first lock sleeve being mounted axially movably in the case main body, a first retainer holding a fastening member engaged with the taper surface and fitted axially movably in the reciprocating rod, and a first spring member applying a spring force to the first lock sleeve toward a rear end portion of the reciprocating rod; a second lock unit including a second lock sleeve with a taper surface whose diameter is large toward the rear end portion of the reciprocating rod, the second lock sleeve being mounted axially movably in the case main body, a second retainer holding a fastening member engaged with the taper surface and fitted axially movably in the reciprocating rod, and a second spring member applying a spring force to the second lock sleeve toward the tip portion of the reciprocating rod; a driving cylinder attached to the case main body, containing axially movably a driving piston provided with a rear end of the reciprocating rod, and having a advance pressure chamber and a retreat pressure chamber; and a fastening cylinder attached to the case main body and containing a fastening rod so as to be reciprocable in a fastening direction and a fastening release direction, a fastening surface contacting with respective inclined surfaces formed on the first and second lock sleeves so as to face to each other being formed on the fastening rod, wherein the fastening rod causes the first and second lock sleeves to move in reverse directions and fixes the reciprocating rod by the first and second lock units.

The fluid pressure cylinder according to the present invention is such that a spring member applying a spring force to the fastening rod in a fastening direction is provided in the fastening cylinder, and a release pressure chamber applying a fluid pressure in the fastening release direction to the fastening piston provided in the fastening rod is formed in the fastening cylinder.

The fluid pressure cylinder according to the present invention is such that the retreat pressure chamber and the release pressure chamber are communicated by a communication path, and a throttle generating back pressure in the retreat pressure chamber at a time of a forward movement of the reciprocating rod is provided in a retreat flow path for connecting a fluid source and a supply/discharge port that supplies and discharges fluid to and from the retreat pressure chamber.

The fluid pressure cylinder according to the present invention is such that the communication path is formed in the fastening cylinder, the supply/discharge port is provided in the case main body, and the release pressure chamber and the retreat pressure chamber are communicated via the case main body.

The fluid pressure cylinder according to the present invention is such that a throttle for exerting a resisting force on fluid flowing from the case main body into the retreat pressure chamber is provided in a cover partitioning the case main body and the driving cylinder.

The fluid pressure cylinder according to the present invention is such that a fastening pressure chamber for applying pressure in a fastening direction to the fastening piston is formed in the fastening cylinder and a supply/discharge port communicating with the fastening pressure chamber is formed, and a valve member for making the supply/discharge port and the fastening pressure chamber communicate with each other when the fastening rod moves a predetermined stroke in the fastening direction is mounted in the fastening rod.

The fluid pressure cylinder according to the present invention is such that a throttle for generating back pressure in the advance pressure chamber at a time of a retreat movement of the reciprocating rod is provided in an forward flow path for connecting a fluid source and a supply/discharge port that supplies and discharges fluid to and from the advance pressure chamber.

According to the present invention, the reciprocating rod incorporated axially reciprocably in the case main body and driven axially by the driving cylinder can be fixed by driving the two lock units together using one fastening rod. Since the two lock units can be driven by the one fastening rod, the fluid pressure cylinder can be downsized.

Since a spring force can be applied to the fastening rod in the fastening direction, if the fluid pressure in the fastening release direction is released, the reciprocating piston can be held in a stopping state by the spring force. When the release pressure chamber and the retreat pressure chamber are communicated and the back pressure is generated in these chambers, the fastening rod can be held at a fastening release position by the back pressure at a time of the advance movement of the reciprocating piston. Since the release pressure chamber and the retreat pressure chamber are communicated inside the case main body and the supply/discharge port is provided in the case main body, it is possible to supply/discharge the fluid to/from the release pressure chamber and the retreat pressure chamber through the one supply/discharge port. Since the throttle for exerting the resisting force on the fluid flowing into the retreat pressure chamber is provided in the cover partitioning the case main body and the driving cylinder, it is possible to set long a time required until the reciprocating rod is moved backward after the fastening rod is moved backward by acting on the release pressure chamber from an interior of the case main body.

When the fastening force exerted on the reciprocating rod by the fastening piston is applied to the spring force and the fluid pressure is added to the fastening force after the fastening rod approaches a predetermined stroke or more to a fastening completing position, it is possible to exert a large fastening force on the reciprocating rod at a time of fastening completion.

When the throttle exerts the resisting force on the fluid discharged from the advance pressure chamber at the time of the backward movement of the reciprocating rod, the reciprocating rod can be slowly moved backward.

BEST MODE FOR CARRYING OUT THE INVENTION

Figure 1A:
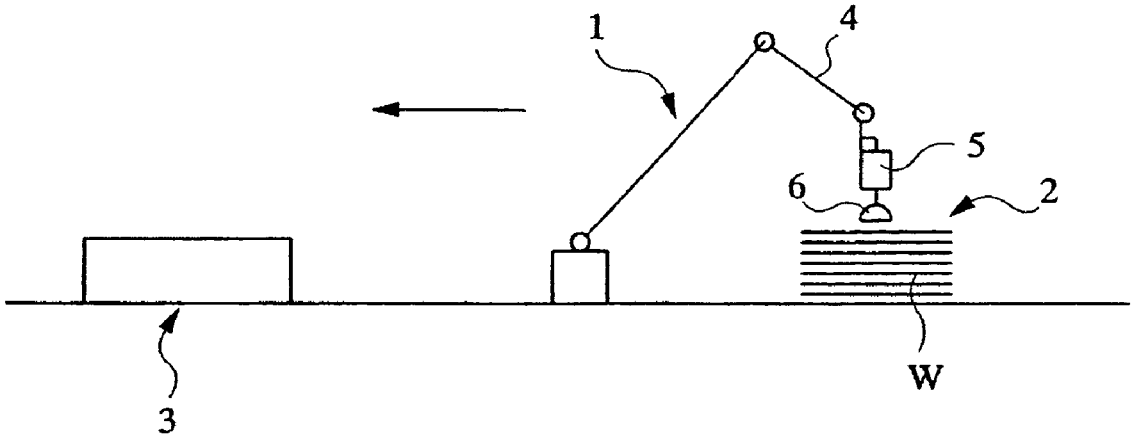
FIG. 1A is a schematic diagram showing a robot as a carrying apparatus for vacuum-holding and transferring a workpiece and FIG. 1B is a schematic diagram showing a carrying truck for transferring the workpiece in a state of being clamped.

Hereinafter, embodiments according to the present invention will be detailed on the basis of the drawings. A robot 1 shown in FIG. 1A is a robot for transferring a workpiece W arranged in a workpiece containing unit 2 to a workpiece loading position 3. To a reciprocating rod driven by a fluid pressure cylinder 5 attached to a tip of a robot arm 4, a vacuum-sucking pad 6 for vacuum-holding and transferring the workpiece W is mounted. Under a state where a pressing force is applied to the workpiece W via the vacuum-sucking pad 6 by the fluid pressure cylinder 5, the workpiece W is attached to the robot arm 4 by supplying negative pressure air to the vacuum-sucking pad 6. The fluid pressure cylinder 5 is provided with a fastening cylinder for fixing the reciprocating rod. Therefore, the reciprocating rod is fixed so that the workpiece W does not move with respect to the robot arm 4 when the workpiece W is transferred.

Figure 1B:
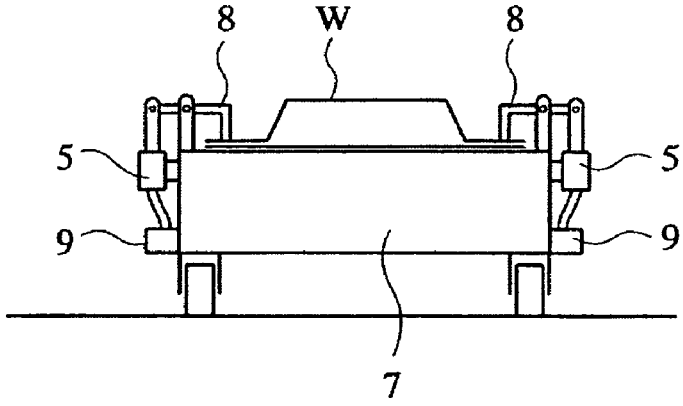

Meanwhile, a carrying truck 7 shown in FIG. 1B is provided with clamp arms 8 for clamping the workpiece W, and these clamp arms 8 are opened/closed by the fluid pressure cylinders 5. When this carrying truck 7 reaches a workpiece introducing position and a workpiece carrying-out position, compressed air is supplied from the outside to the fluid pressure cylinders 5 via a supply/discharge joint unit 9, whereby opening/closing operations of the clamp arms 8 are performed. Accordingly, when the carrying truck 7 transfers the workpiece, fluid is not supplied from the outside to the fluid pressure cylinders 5. However, by fixing each reciprocating rod of the fluid pressure cylinders 5, the clamp arms 8 are each held in a clamping state.

Figure 2:
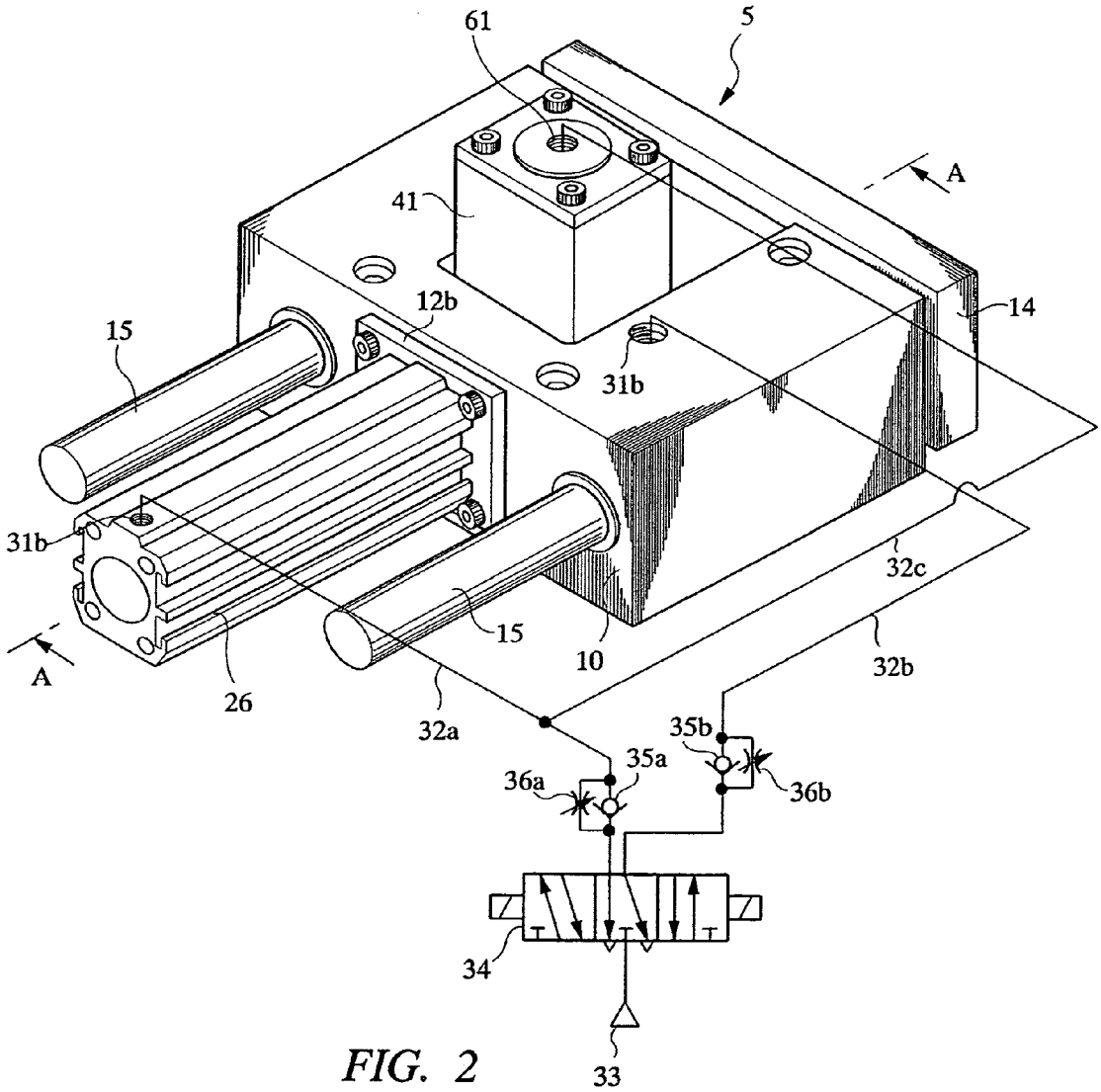
FIG. 2 is a perspective view showing a fluid pressure cylinder to be loaded on the robot shown in FIG. 1A.
Figure 3:
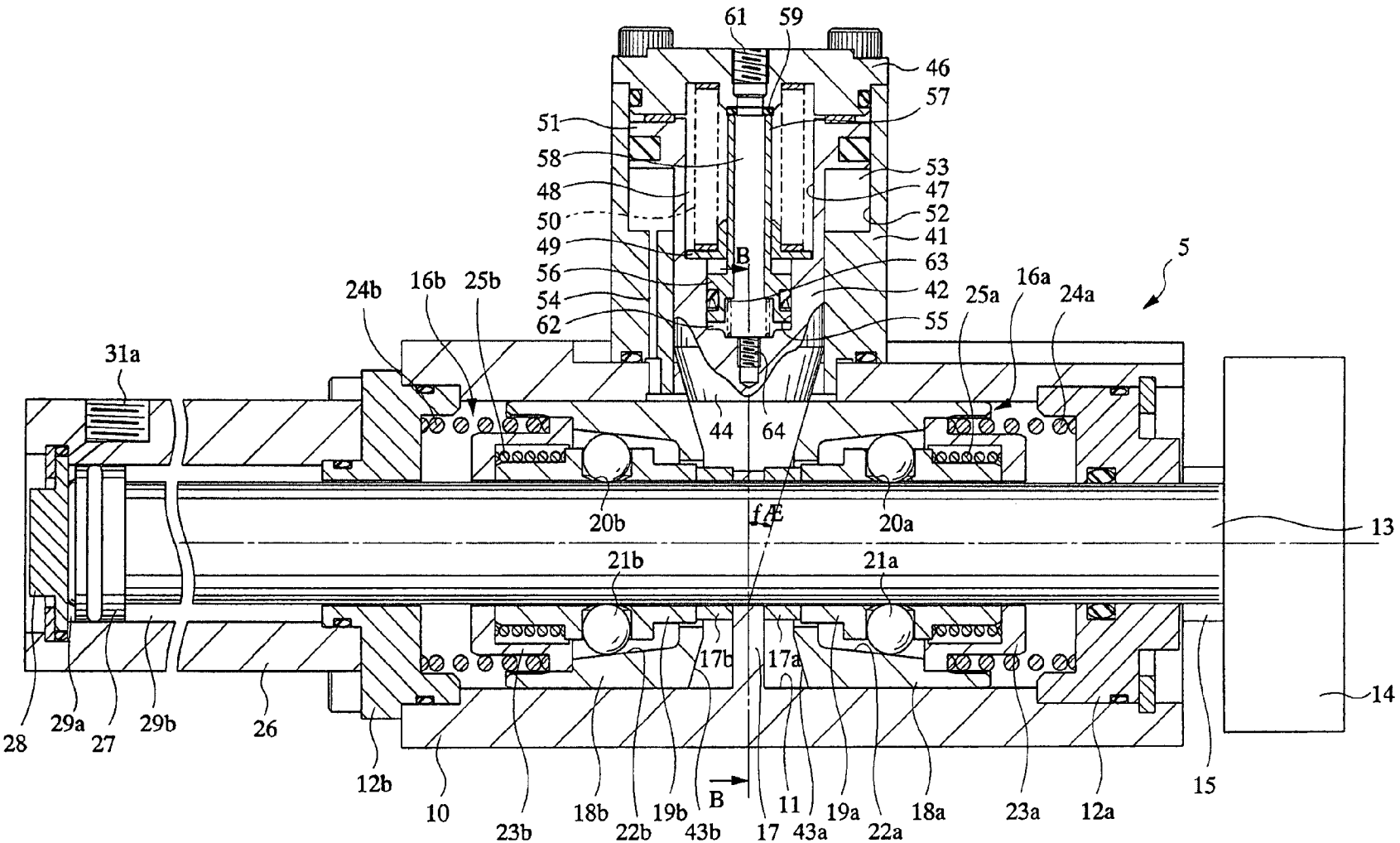
FIG. 3 is a cross-sectional view taken along line A-A in FIG. 2.

As shown in FIG. 2, this fluid pressure cylinder 5 has a substantially rectangular case main body 10, and a unit containing hole 11 as shown in FIG. 3 is formed in the case main body 10. This unit containing hole 11 is a cylindrical hole. Two covers 12*a* and 12*b* are attached to the case main body 10 so as to block both end portions of the unit containing hole 11, and a reciprocating rod 13 is mounted in the case main body 10 so as to be reciprocable axially through both covers 12*a* and 12*b*. A linking plate 14 is fixed to one end portion of this reciprocating rod 13. When this fluid pressure cylinder 5 is used in a carrying apparatus shown in FIG. 1A, the vacuum-sucking pad 6 is attached to the linking plate 14 via a bracket, a jig or the like. A tip portion of the reciprocating rod 13 is an end portion fixed to the linking plate 14, and the reciprocating rod reciprocates in such both directions that a direction of the linking plate 14 separating from the case main body 10 is set as a forward movement and a direction of the linking rod approaching to the case main body is set as a backward movement.

As shown in FIG. 2, two guide rods 15 are respectively fixed to the linking plate 14 so as to be on both sides of and in parallel to the reciprocating rod 13. Each of the guide rods 15 is supported slidably by the case main body 10 and protrudes outward from a rear end portion side of the case main body 10, whereby a bending force exerted on the reciprocating rod 13 is reduced by the guide rods 15 and the rotation is prevented, so that the reciprocating rod 13 smoothly moves forward and backward.

Figure 4:
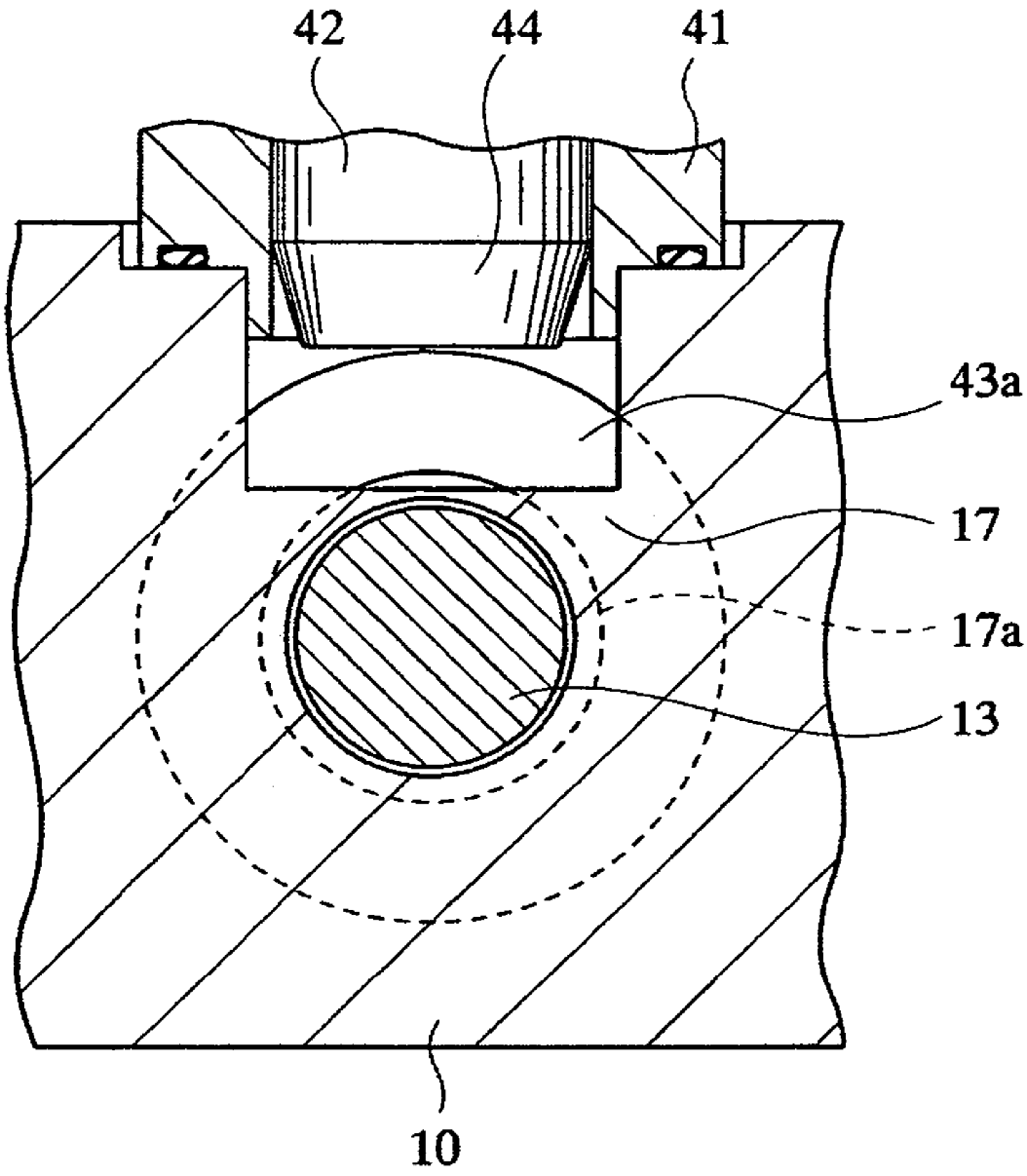
FIG. 4 is a cross-sectional view taken along line B-B in FIG. 3.

The case main body 10 is provided with a stopper 17 that protrudes in the unit containing hole 11 and, as shown in FIG. 4, this stopper 17 is formed integrally with the case main body 10. In the unit containing hole 11, two first and second lock units 16*a* and 16*b* are incorporated in opposite directions to each other, and the first lock unit 16*a* is disposed on a right side of the stopper 17 in FIG. 3, namely, on a tip portion side of the reciprocating rod 13, and a second lock unit 16*b* is disposed on a left side of the stopper 17, namely, on a rear end portion side of the reciprocating rod 13.

The lock unit 16*a* comprises: a lock sleeve 18*a* that has an outer circumferential surface contacting slidably with an inner circumferential surface of the unit containing hole 11 and is movable axially in the case main body 10; and a retainer 19*a* that is incorporated in the lock sleeve 18*a* and is fitted axially movably in the reciprocating rod 13. A movement of the retainer 19*a* to the rear end portion side of the reciprocating rod 13 is restricted by the stopper 17 via a sleeve 17*a* fitted relatively movably with respect to the reciprocating rod 13.

In the retainer 19*a*, holding holes 20*a* radially penetrating are formed circumferentially per predetermined interval on the same surface as that in a radial direction of the retainer 19*a*. In each of the holding holes 20*a*, a plurality of balls as fastening members, namely, steel balls 21*a* are incorporated. So as to face to the steel balls 21*a*, a taper surface 22*a* whose diameter becomes larger toward a tip portion side of the reciprocating rod 13 is formed on the inner circumferential surface of the lock sleeve 18*a*. Thereby, when the lock sleeve 18*a* moves toward a rod tip side, the lock sleeve 18*a* exerts a pressing force directed toward a center of the reciprocating rod 13 on the steel balls 21*a* and applies a fastening force to the reciprocating rod 13 via the steel balls 21*a*. Note that so long as a fastening member is a member that can apply a fastening force to the reciprocating rod 13 by axial-directional movement of the lock sleeve 18*a*, an annular member in which a slit is formed may be employed instead of the steel balls 21*a*.

A spring receiving tube 23*a* is assembled between the lock sleeve 18*a* and the retainer 19*a*. An outer flange that protrudes outward is formed at one end of the spring receiving tube 23*a* and an inner flange that protrudes inward is formed at the other end thereof. A compression coil spring 24*a* is assembled between the outer flange and the cover 12*a*. A compression coil spring 25*a* is assembled between a protrusion portion formed on the retainer 19*a* and the inner flange. By the compression coil spring 24*a*, a spring force directed toward a rod rear end portion is exerted on the lock sleeve 18*a*. By the compression coil spring 25*a*, a spring force directed toward the rod rear end portion is exerted on the retainer 19*a* in the same manner.

The second lock unit 16*b* is formed by reversely arranging the same members as those constituting the first lock unit 16*a*. The symbol "a" is denoted to the members constituting the first lock unit 16*a*, while the symbol "b" is denoted to members constituting the second lock unit 16*b*. Therefore, repetitive explanations thereof will be omitted herein. Since the respective members constituting the lock units 16*a* and 16*b* are arranged in reverse directions to each other in this manner, the lock sleeve 18*b* is incorporated in the case main body 10 so that the taper surface 22*b* formed on the inner circumferential surface of the lock sleeve 18*b* makes a rod rear end portion a larger diameter. A movement of the retainer 19*b* to a tip portion side of the reciprocating rod 13 is restricted by the stopper 17 via a sleeve 17*b* fitted relatively movably with respect to the reciprocating rod 13.

In order to reciprocate the reciprocating rod 13 axially, a cover 12*b* on a rod rear end side is provided with a driving cylinder 26. In the driving cylinder 26, a rear end portion of the reciprocating rod 13 is contained and also a driving piston 27 fixed to the reciprocating rod 13 is incorporated. An advance pressure chamber 29*a* between a cover 28 fixed to the driving cylinder 26 and the driving piston 27 and a retreat pressure chamber 29*b* between the driving piston 27 and the cover 12*b* are partitioned and formed in the driving cylinder 26. In the driving cylinder 26, a supply/discharge port 31*a* that communicates with the advance pressure chamber 29*a* is formed as shown in FIG. 3. In the case main body 10, a supply/discharge port 31*b* that communicates with the retreat pressure chamber 29*b* is formed as shown in FIG. 2. This supply/discharge port 31*b* communicates with the unit containing hole 11, and also communicates with the retreat pressure chamber 29*b* via a clearance between members constituting the lock unit 16*b*, a clearance between the reciprocating rod 13 and the retainer 19*b*, and a clearance between the cover 12*b* and the reciprocating rod 13. However, the supply/discharge port 31*b* may be formed in the driving cylinder 26, and the supply/discharge port 31*b* may be made to communicate directly with the retreat pressure chamber 29*b*.

As shown in FIG. 2, the supply/discharge port 31*a* is connected via a directional control valve 34 to an air pressure source 33 serving as a fluid source by an advance flow path 32*a*, and the supply/discharge port 31*b* is connected via the directional control valve 34 to the air pressure source 33 by a retreat flow path 32*b*. This directional control valve 34 performs a switching operation to three positions, an advance position of transmitting a driving signal to one coil to supply air pressure to the supply/discharge port 31*a* and discharge air from the supply/discharge port 31*b*, a retreat position of transmitting a driving signal to the other coil to supply air pressure to the supply/discharge port 31*b* and discharge air from the supply/discharge port 31*a*, and a discharge position of discharging air from both of the supply/discharge ports 31*a* and 31*b*. When switched to the discharge position, compressed air in both of the pressure chambers 29*a* and 29*b* is discharged.

The retreat flow path 32*a* is provided with a check valve 35*a* that permits flow directed toward the supply/discharge port 31*a* and blocks flow directed in a reverse direction thereof. A throttle 36*a* is provided in parallel with the check valve, and the retreat flow path 32*b* is provided with a check valve 35*b* and a throttle 36*b* in the same manner. Accordingly, when the directional control valve 34 is operated to supply compressed air to the advance pressure chamber 29*a*, the reciprocating rod 13 moves forward. When compressed air is supplied to the retreat pressure chamber 29*b*, the reciprocating rod 13 moves backward. Therefore, in order to move forward the reciprocating rod 13 which has been in a retreat state, the directional control valve 34 is switched from the discharge position to the retreat position before supplying compressed air to the advance pressure chamber 29*a*, and the directional control valve 34 is switched to the advance position to supply the compressed air to the advance pressure chamber 29*a* after supplying the compressed air to the retreat pressure chamber 29*b*. Thereby, when the reciprocating rod 13 moves forward, air in the retreat pressure chamber 29*b* is discharged via the throttle 36*b* to the outside, so that back pressure occurs in the retreat pressure chamber 29*b* and the unit containing hole 11. In the same manner, when the reciprocating rod 13 moves backward, compressed air is previously supplied to the advance pressure chamber 29*a* and then the compressed air is supplied to the retreat pressure chamber 29*b*, so that back pressure occurs in the advance pressure chamber 29*a* by the throttle 36*a*.

As shown in FIG. 3, a fastening cylinder 41 is attached to the case main body 10 at a right angle to the reciprocating rod 13. In this fastening cylinder 41, a fastening rod 42 is incorporated so as to be reciprocable in a fastening direction of moving forward to the reciprocating rod 13 and in a fastening release direction of moving backward from the reciprocating rod 13, wherein a center of the fastening rod 42 is located at a central position between the two lock units 16*a* and 16*b*. Inclined surfaces 43*a* and 43*b* are formed on end surfaces of the two lock sleeves 18*a* and 18*b* so as to face to each other, and a fastening surface 44 constituted by a conical surface formed at a tip portion of the fastening rod 42 contacts with both of the inclined surfaces 43*a* and 43*b*. If an inclined angle of the fastening surface 44 to a central axis of the fastening rod 42 is defined as "θ", the inclined surfaces 43*a* and 43*b* are inclined at an angle corresponding to the incline angle. Therefore, a thrust exerted on the fastening rod 42 is expanded by a wedge effect and transmitted to axial-directional movements of the two lock sleeves 18*a* and 18*b*, and the lock sleeves 18*a* and 18*b* move in the reverse direction to each other. When illustrated in the drawing, the angle "θ" is set to approximately 15 degrees.

A cover 46 is fixed to an end portion of the fastening cylinder 41 and, by the cover 46 and a spring containing hole 47 formed so as to open in a rear end surface of the fastening rod 42, a fastening pressure chamber 48 is formed in the fastening rod 42. A compression coil spring 50 for applying a spring force to the fastening rod 42 in a forward direction is incorporated in the fastening pressure chamber 48 so that both ends of the compression coil spring contact with the cover 46 and a spring receiving sleeve 49 located at a step portion on a bottom surface of the spring containing hole 47. The rear end portion of the fastening rod 42 is provided integrally with a fastening piston 51, and an outer circumferential surface of the fastening piston 51 contacts with an inner circumferential surface of a cylinder hole 52 formed in the fastening cylinder 41, and an interior of the cylinder hole 52 is partitioned by the fastening piston 51 into a release pressure chamber 53 and a fastening pressure chamber 48.

Since the release pressure chamber 53 communicates with the unit containing hole 11 by a communication path 54, the release pressure chamber 53 communicates with the supply/discharge port 31*b* via the unit containing hole 11. Accordingly, one supply/discharge port 31*b* can be used in common for supply/discharge of compressed air to/from the retreat pressure chamber 29*b* and the release pressure chamber 53. However, by causing the supply/discharge port to directly communicate with the release pressure chamber 53, the supply/discharge port may be formed in the fastening cylinder 41.

When compressed air is supplied to the supply/discharge port 31*b* while moving the reciprocating rod 13 backward, the compressed air at first flows from the unit containing hole 11 into the release pressure chamber 53 via the communication path 54 and the fastening rod 42 reaches a retreat limit position shown in FIG. 3. Next, by the compressed air that is throttled via the clearance between the reciprocating rod 13 and the cover 12*b* and the like and flows into the retreat pressure chamber 29*b*, the reciprocating rod 13 moves backward. At this backward movement, since the advance flow path 32*a* is provided with the throttle 36*a*, back pressure occurs in the advance pressure chamber 29*a* and the reciprocating rod 13 is decelerated and moves slowly without rapidly moving to the retreat limit position.

On the other hand, when the compressed air is supplied from the supply/discharge port 31*a* under a state where the reciprocating rod 13 has moved backward, the air in the unit containing hole 11 is discharged from the supply/discharge port 31*b* via the throttle 36*b*. Therefore, by the back pressure in the retreat pressure chamber 29*b*, the reciprocating rod 13 is decelerated and moves forward slowly and the fastening rod 42 continues to be held at the fastening release position. When there is no back pressure in the unit containing hole 11 and the retreat pressure chamber 29*b*, the compressed air in the release pressure chamber 53 is also discharged via the communication path 54 to the outside, so that the fastening rod 42 moves forward to the reciprocating rod 13 by a spring force of the compression coil spring 50.

In order to supply compressed air into the fastening pressure chamber 48 and apply a fastening force by the fastening rod 42 when the fastening rod 42 moves forward a predetermined stroke or more, an auxiliary cylinder hole 55 that communicates with the spring containing chamber 47 via the step portion is formed in the fastening rod 42. In this auxiliary cylinder hole 55, a hollow auxiliary piston 56 is incorporated so as to be reciprocable axially. The auxiliary piston 56 is provided integrally with a hollow bar-shaped valve member 57, and a through hole 58 is formed so as to pass through interiors of the auxiliary piston 56 and the valve member 57, and an end surface of the valve member 57 abuts on a valve seat 59 made of a sealing material and provided on the cover 46.

A supply/discharge port 61 is formed in the cover 46 so as to correspond to the valve member 57, and this supply/discharge port 61 communicates with the through hole 58, whereby the air that flows from the supply/discharge port 61 into the through hole 58 is supplied to a sealing pressure chamber 62 located on a tip surface side of the auxiliary piston 56. A compression coil spring 63 for applying a spring force to the auxiliary piston 56 in a direction of pressing the valve seat 59 is incorporated in the sealing pressure chamber 62. Accordingly, when the fastening piston 51 moves forward a predetermined stroke toward the reciprocating rod 13 until the spring receiving sleeve 49 abuts on the auxiliary piston 56, the end surface of the valve member 57 becomes in a state of abutting on the valve seat 59 and continues to press the valve seat 59 by the pressure in the sealing pressure chamber 62 and the spring force of the compression coil spring 63.

When the fastening piston 51 moves beyond this stroke, the auxiliary piston 56 abuts on the spring receiving sleeve 49 and moves together with the fastening piston 51 toward the reciprocating rod 13, so that the valve member 57 separates from the valve seat 59. As a result, the supply/discharge port 61 becomes in a state of communicating with the fastening pressure chamber 48, and a thrust in a direction of moving forward the fastening rod 42 is exerted on the fastening piston 51. In this manner, the hollow valve member 57 is switched to a state of communicating with the supply/discharge port 61 and the fastening pressure chamber 48 and a state of closing the communication. In the fastening rod 42, a screw hole 64 is opened in the sealing pressure chamber 62 and is formed coaxially with the supply/discharge port 61, so that, by detaching a pipe connected to the supply/discharge port 61 and screwing a bar-shaped tool to the screw hole 64 and pulling the tool, the fastening rod 42 can be manually moved backward to the fastening release position.

The supply/discharge port 61 is, as shown in FIG. 2, connected via a pressurization flow path 32*c* to the advance flow path 32*a*, and when compressed air is supplied to the advance pressure chamber 29*a* by an operation of the directional control valve 34, the compressed air is supplied to the supply/discharge port 61 at the same time. Accordingly, as shown in FIG. 3, when the directional control valve 34 is operated under a sate where the reciprocating rod 13 is at the retreat limit position and when compressed air is supplied into the advance pressure chamber 29*a*, the reciprocating rod 13 moves forward and the compressed air is supplied to the supply/discharge port 61. However, without connecting the pressurization flow path 32*c* to the advance flow path 32*a*, fluid may be supplied/discharged to/from the supply/discharge port 61 by a directional control valve other than the directional control valve 34.

When the reciprocating rod 13 moves forward, predetermined back pressure is held in the unit containing hole 11 by the throttle 36*b* provided in the retreat flow path 32*b*, so that the back pressure flows into the release pressure chamber 53 and the fastening rod 42 reaches the fastening release position, namely, the retreat limit position as shown in FIG. 3. Under this state, the reciprocating rod 13 moves forward to a predetermined position and the forward movement of the reciprocating rod 13 is restricted. Or, when the directional control valve 34 is operated and the supply of compressed air to the advance pressure chamber 29*a* is stopped, air is discharged from the unit containing hole 11 and the back pressure decreases and the fastening rod 42 moves forward to the fastening position by the spring force of the compression coil spring 50. However, until the fastening rod 42 moves forward a predetermined stroke or more, the communication between the supply/discharge port 61 and the fastening pressure chamber 48 is blocked by the valve member 57.

Figure 5:
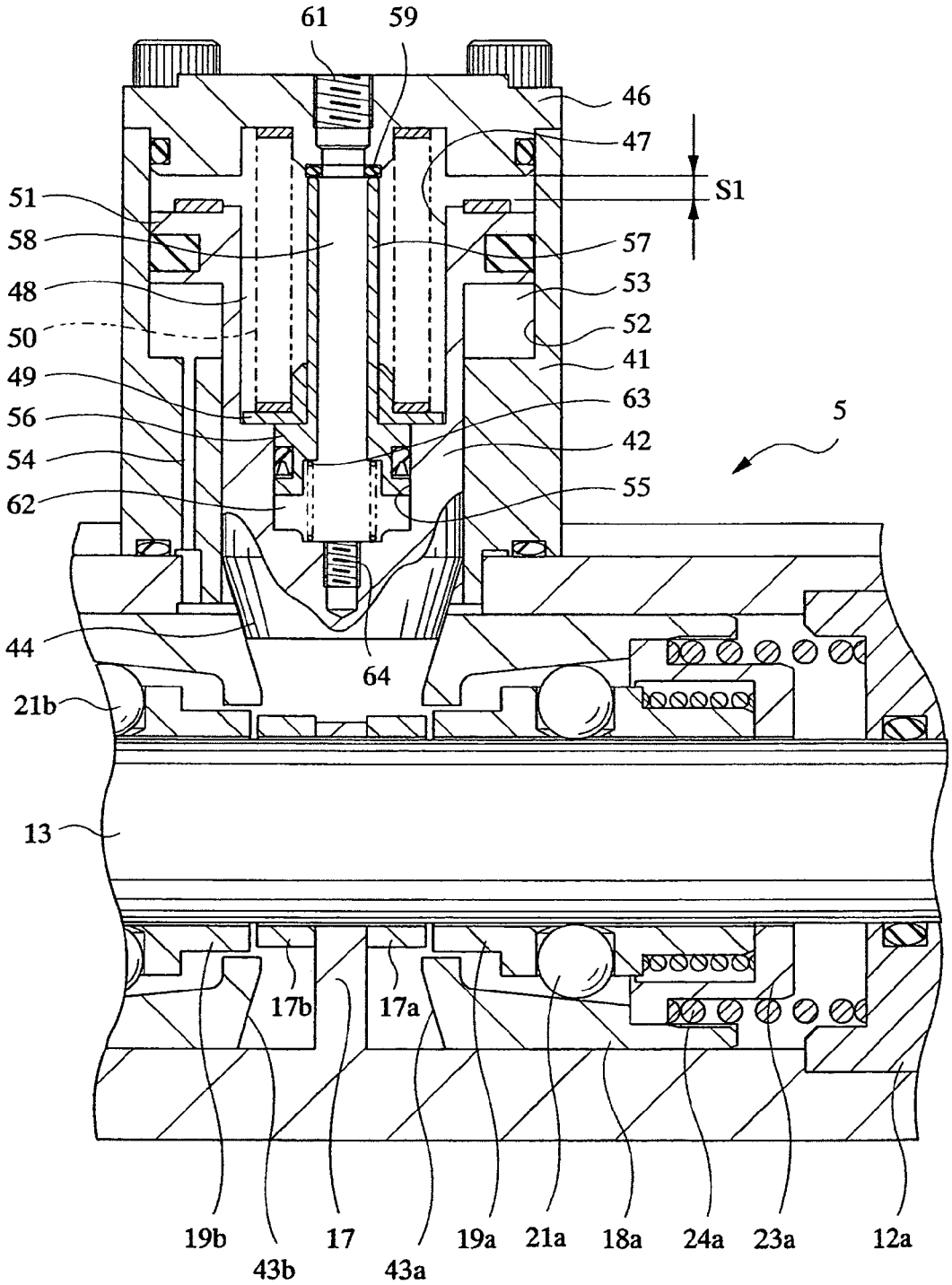
FIG. 5 is a cross-sectional view showing a state where a fastening rod moves forward to a center position.
Figure 6:
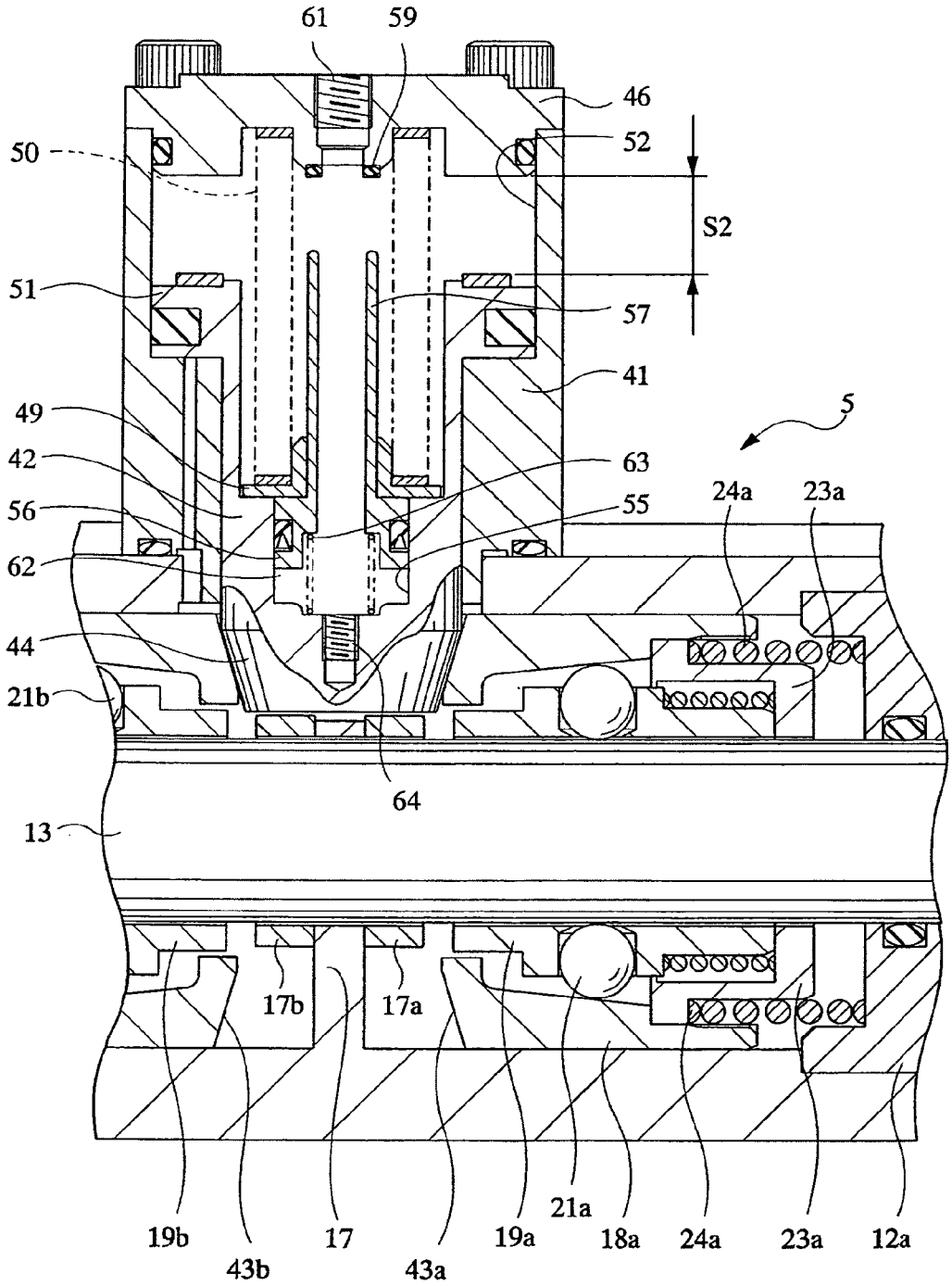
FIG. 6 is a cross-sectional view showing a state where the fastening rod moves forward to a fastening position.

FIG. 5 is a cross-sectional view showing a state where the fastening rod 42 moves forward a stroke S1 up to an intermediate position, and FIG. 6 is a cross-sectional view showing a state where the fastening rod 42 moves forward a stroke S2 up to a fastening position. When the fastening rod 42 moves forward by the position shown in FIG. 5, the spring receiving sleeve 49 that has moved forward together with the fastening rod 42 contacts with the auxiliary piston 56 and when the fastening rod 42 further moves forward, the auxiliary piston 56 moves forward together with the fastening rod 42, so that, as shown in FIG. 6, the valve member 57 separates from the valve seat 59. Thereby, the supply/discharge port 61 becomes in a state of communicating with the fastening pressure chamber 48, and the compressed air supplied to the supply/discharge port 61 pressurizes the fastening piston 51. When the fastening rod 42 moves forward from a state shown in FIG. 5 to a state shown in FIG. 6, the thrust of the total of the spring force and the air pressure is exerted on the fastening rod 42. Accordingly, when the fastening is completed, a larger thrust than that at a fastening start time is applied from the fastening rod 42 to the lock sleeves 18*a* and 18*b*.

Thus, in a process in which the fastening rod 42 moves forward from the fastening release position to the fastening position, the two lock sleeves 18*a* and 18*b* are driven in the reverse directions to each other against the spring force of the compression coil springs 24*a* and 24*b* by the fastening rod 42, and the lock sleeves 18*a* and 18*b* are fastened to the reciprocating rod 13 via the steel balls 21*a* and 21*b*, whereby the reciprocating rod 13 is locked to the case main body 10. Under this state, when an axial force is exerted on the reciprocating rod 13 in a direction of making the reciprocating rod move forward, the steel balls 21*b* in one lock unit 16*b* are subjected to an external force in a direction of entering the taper surface 22*b* to apply the fastening force more strongly to the reciprocating rod 13. On the other hand, when an axial force in a direction of making the reciprocating rod 13 move backward is exerted on the reciprocating rod 13, the steel balls 21*a* in the other lock unit 16*a* are subjected to an external force in a direction of entering the taper surface 22*a* to apply the fastening force more strongly to the reciprocating rod 13. Accordingly, the two lock units 16*a* and 16*b* in the reverse directions to each other are disposed outside the reciprocating rod 13, so that, under a state where the reciprocating rod 13 is fixed, even if the external force is k applied to the reciprocating rod 13 in either of the forward and backward directions, it is possible to certainly prevent the reciprocating rod 13 from moving.

When the reciprocating rod 13 is moved from the advance limit position to the retreat limit position, the directional control valve 34 is operated and compressed air is supplied to the supply/discharge port 31*b*, so that the compressed air flows into the unit containing hole 11. The air that flows into the hole is throttled and flows into the retreat pressure chamber 29*b*, so that by pressure of the air that flows into the release pressure chamber 53 via the communication path 54 before the driving piston 27 is moved backward, the fastening rod 42 moves backward to the fastening release position. When the backward movement is completed, the fastening of the reciprocating rod 13 becomes in a release state and thereafter, by the compressed air in the retreat pressure chamber 29*b*, the reciprocating rod 13 moves backward. Under a state where the backward movement is completed, when the compressed air in the unit containing hole 11 is discharged, the fastening rod 42 moves forward by the spring force and the reciprocating rod 13 is fastened. Note that when compressed air is supplied into the fastening pressure chamber 48 and a thrust is applied to the fastening rod 42 by air pressure in a state where the reciprocating rod 13 is at the retreat limit position, air pressure pipes are constituted so as to supply the compressed air from the supply/discharge port 61.

Next, the advance and retreat movements of the reciprocating rod 13 by the fluid pressure cylinder as mentioned above and the fastening and fastening release operations of the reciprocating rod 13 by the fastening rod 42 will be explained hereinafter. Under a state where the reciprocating rod 13 is at the retreat limit position, if the directional control valve 34 shown in FIG. 2 is at the discharge position, the fastening rod 42 moves forward up to the fastening position and the reciprocating rod 13 becomes in a state of being fixed by the two lock units 16*a* and 16*b*. In order to move the reciprocating rod 13 forward under such a state, the directional control valve 34 is operated to the retreat position and compressed air is first supplied to the supply/discharge port 31*b* and then the directional control valve is switched to the advance position. By first being switched to the retreat position, compressed air is supplied from the supply/discharge port 31*b* into the unit containing hole 11 in the case main body 10, so that the pressure in the unit containing hole 11 is applied to the fastening rod 42 and, by the air that flows via the communication path 54 into the release pressure chamber 53, the pressure is applied to the fastening piston 51. Therefore, the fastening rod 42 moves backward up to the fastening release position as shown in FIG. 3.

After the reciprocating rod 13 is thus at the retreat limit position, compressed air is supplied to the supply/discharge port 31*a* and the compressed air flows from the supply/discharge port 31*a* into the advance pressure chamber 29*a*, whereby the reciprocating rod 13 moves forward. However, the back pressure occurs in the compressed air within the unit containing hole 11 by the throttle 36*b*, and this back pressure is applied via the communication path 54 to the release pressure chamber 53, whereby the fastening piston 51 is held at the fastening release position. The reciprocating rod 13 is driven, in the state where its fastening is being released, in a forward direction by the forward-directional thrust applied to the driving piston 27. While moving forward, the fastening piston 51 holds the fastening release position by the back pressure occurring in the unit containing hole 11. When the reciprocating rod 13 arrives at the advance limit position or if such a resisting force as to restrict the forward movement of the reciprocating rod 13 is applied during its arrival and the reciprocating rod 13 stops, the air in the unit containing hole 11 is discharged via the throttle 36*b* to the outside. Therefore, the fastening rod 42 moves forward to the fastening position by the spring force of the compression coil spring 50. The fastening rod 42 moves forward only by the spring force from the fastening release position shown in FIG. 3 until the spring receiving sleeve 49 runs into the auxiliary piston 56 shown in FIG. 5.

Next, when the fastening rod 42 move forward further from the position shown in FIG. 5, the valve member 57 separates from the valve seat 59 and the compressed air of the supply/discharge port 61 flows into the fastening pressure chamber 48 and the pressure of the compressed air is applied to the fastening piston 51. Thereby, the spring force and the air pressure are applied to the fastening rod 42, and as the fastening rod 42 reaches the fastening position, a large thrust is exerted on the fastening rod 42.

When the fastening rod 42 moves forward from the fastening release position shown in FIG. 3 to the fastening position shown in FIG. 6, the two lock sleeves 18*a* and 18*b* are driven in the reverse directions to each other by a fastening surface 44 provided to a tip of the fastening rod 42 and a fastening force is applied to the reciprocating rod 13 via the steel balls 21*a* and 21*b*. By the two lock sleeves 18*a* and 18*b* that move in the reverse directions to each other, the fastening force is applied to the reciprocating rod 13. Therefore, even if external forces in the forward and backward directions are applied to the reciprocating rod 13, the reciprocating rod 13 is certainly held in a fixed state. Upon a state where the fastening rod 42 moves forward to the fastening position shown in FIG. 6, even if the air in the fastening pressure chamber 48 is discharged, the fastening rod 42 is held at the advance limit position by friction between the fastening surface 44 and the inclines surfaces 43*a* and 43*b*.

On the other hand, in moving the reciprocating rod 13 backward, the directional control valve 34 is operated and compressed air is supplied from the supply/discharge port 31*b*. However, if compressed air is supplied to the supply/discharge port 31*a* before operating the directional control valve, the back pressure occurs by the throttle 36*a* when the reciprocating rod 13 moves backward. Accordingly, movement speed of the reciprocating rod 13 is reduced, whereby the reciprocating rod can be slowly moved.

When the directional control valve 34 is operated and the compressed air is supplied from the supply/discharge port 31*b* into the unit containing hole 11, the compressed air in the unit containing hole 11 flows first via the communication path 54 into the release pressure chamber 53 and the fastening rod 42 moves backward from the fastening position to the fastening release position. Next, by the compressed air flowing into the retreat pressure chamber 29*b*, the reciprocating rod 13 moves backward. When the reciprocating rod 13 moves up to the retreat limit position, if the directional control valve 34 is switched to the discharge position, the fastening rod 42 moves forward to the fastening position by the spring force and a fastening force is applied to the reciprocating rod 13 in the same manner as mentioned above. At this time, in order to enhance the fastening force, compressed air may be supplied from the supply/discharge port 61 into the fastening pressure chamber 48.

If the fluid pressure cylinder 5 shown in FIG. 2 to FIG. 6 is applied to the workpiece carrying apparatus shown in FIG. 1A, a force for pressing the workpiece is applied to the vacuum-holding pad 6 by the compressed air supplied to the advance pressure chamber 29*a* in the driving cylinder 26. In a sate of exerting the pressing force, if the reciprocating rod 13 is held in a stopping state, the air in the release pressure chamber 53 and that of the unit containing hole 11 are discharged via the throttle 36*b* and the fastening rod 42 moves forward by the spring force, whereby the reciprocating rod 13 is set to the fastening state.

Figure 7:
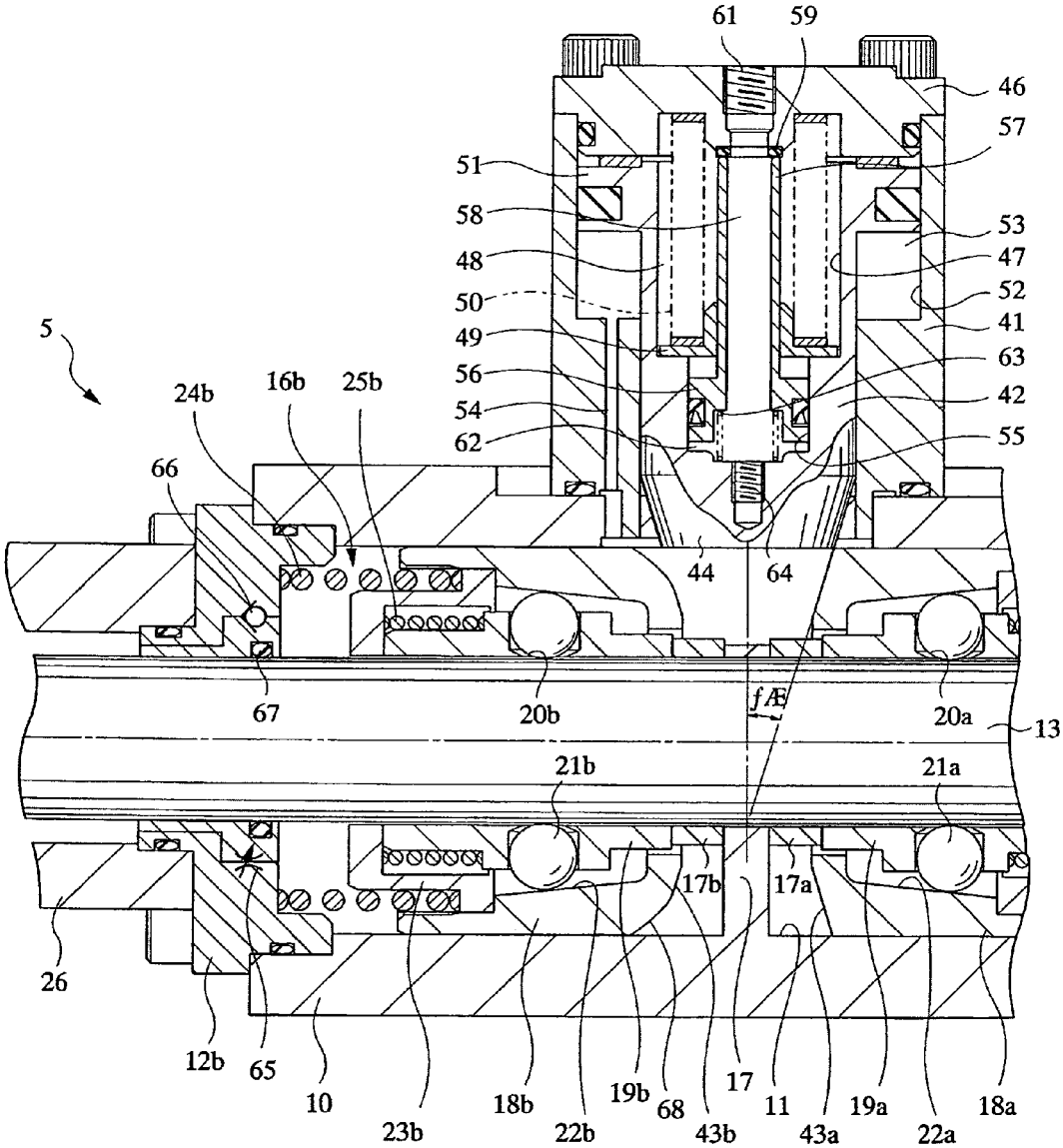
FIG. 7 is a cross-sectional view showing a portion of a fluid pressure cylinder according to another embodiment of the present invention.

FIG. 7 is a cross-sectional view showing a portion of a fluid pressure cylinder according to another embodiment of the present invention. In FIG. 7, members common to those shown in FIG. 3 are denoted by the same reference numerals and repetitive explanations thereof will be omitted.

As shown in FIG. 7, a throttle 65 for throttling the air flowing from the case main body 10 into the retreat pressure chamber 29*b* is incorporated in the cover 12*b* that partitions the case main body 10 and the driving cylinder 26. In addition thereto, a check valve 66 for preventing air from flowing from the unit containing hole 11 into the retreat pressure chamber 29*b* and permitting it to flow in a reverse direction is incorporated in the cover 12*b*. A clearance between the cover 12*b* and the reciprocating rod 13 is sealed with a sealing material 67. In the case shown in FIG. 3, due to the clearance between the reciprocating rod 13 and the cover 12*b* and the like, the air flowing from the unit containing hole 11 into the retreat pressure chamber 29*b* has a flowing resistance, so that the air flowing into the unit containing hole 11 first flows via the communication path 54 into the release pressure chamber 53 and the reciprocating rod 13 moves backward after the fastening rod 42 moves backward. However, as shown in FIG. 7, the throttle 65 is provided, so that when compressed air is supplied from the supply/discharge port 31*b* and the reciprocating rod 13 is moved backward, a shift time required from a backward movement of the fastening rod 42 to the fastening release position to a backward movement of the reciprocating rod 13 can be set long.

In the case shown in FIG. 7, since a notch portion 68 is formed on an outer circumferential portion of the inclined surface 43*b* of one lock sleeve 18*b*, a radius of the inclined surface 43*b* that contacts with a fastening surface 44 of the fastening rod 42 is set smaller than that in the case shown in FIG. 3 and a radius of the inclined surface 43*a* of the other lock sleeve 18*a* is the same as that in the case shown in FIG. 3. Accordingly, in the case shown in FIG. 3, the two lock sleeves 18*a* and 18*b* are driven almost simultaneously by the fastening rod 42. In contrast, in the case shown in FIG. 7, when the fastening rod 42 moves forward, a time difference in movement starting time between the lock sleeves 18*a* and 18*b* is provided so that the lock sleeve 18*a* is first moved and both of the lock sleeves 18*a* and 18*b* are subsequently moved together. Note that a magnitude relation in radius between the inclined surfaces 43*a* and 43*b* may be set reversely to that in the case shown in FIG. 7. In this case, the lock sleeve 18*b* is moved first.

The present invention is not limited to the above-mentioned embodiments and may be variously modified within the scope of not departing from the gist thereof. For example, the fluid pressure cylinder 5 is applied to a workpiece carrying apparatus shown in FIG. 1A, but may be applied also for driving the clamp arm of the carrying truck shown in FIG. 1B. So long as a reciprocating rod that is driven axially is fixed at a predetermined axial-directional position, the present invention may be applied to various use applications. Further, the fluid to be supplied to the fluid pressure cylinder 5 is not limited to air, and other fluid may be employed too.

Furthermore, a thrust in the fastening direction may be applied to the fastening rod 42 by only a spring force. In this case, the valve member 57 formed integrally with the auxiliary piston 56 is removed and the supply/discharge port 61 becomes unnecessary too. Moreover, without using the compression coil spring 50, the fastening piston 51 may be driven in the fastening direction and the fastening release direction by fluid pressure. However, in such a case, in order to apply a thrust in the fastening direction to the fastening piston 51 even when the reciprocating rod 13 is fixed, the fluid pressure continues to be supplied.

The invention claimed is:

1. A fluid pressure cylinder comprising:

a case main body in which a reciprocating rod is mounted so as to be reciprocable in a forward direction and a backward direction;

a first lock unit including a first lock sleeve with a taper surface whose diameter is large toward a tip portion of the reciprocating rod, the first lock sleeve being mounted axially movably in the case main body, a first retainer holding a fastening member engaged with the taper surface and fitted axially movably in the reciprocating rod, and a first spring member applying a spring force to the first lock sleeve toward a rear end portion of the reciprocating rod;

a second lock unit including a second lock sleeve with a taper surface whose diameter is large toward the rear end portion of the reciprocating rod, the second lock sleeve being mounted axially movably in the case main body, a second retainer holding a fastening member engaged with the taper surface and fitted axially movably in the reciprocating rod, and a second spring member applying a spring force to the second lock sleeve toward the tip portion of the reciprocating rod;

a driving cylinder attached to the case main body, containing axially movably a driving piston provided with a rear end of the reciprocating rod, and having a advance pressure chamber and a retreat pressure chamber; and a fastening cylinder attached to the case main body and containing a fastening rod so as to be reciprocable in a fastening direction and a fastening release direction, a fastening surface contacting with respective inclined surfaces formed on the first and second lock sleeves so as to face to each other being formed on the fastening rod, wherein the fastening rod causes the first and second lock sleeves to move in reverse directions and fixes the reciprocating rod by the first and second lock units.

2. The fluid pressure cylinder according to claim 1, wherein a spring member applying a spring force to the fastening rod in a fastening direction is provided in the fastening cylinder, and a release pressure chamber applying a fluid pressure in the fastening release direction to the fastening piston provided in the fastening rod is formed in the fastening cylinder.

3. The fluid pressure cylinder according to claim 2, wherein the retreat pressure chamber and the release pressure chamber are communicated by a communication path, and a throttle generating back pressure in the retreat pressure chamber at a time of a forward movement of the reciprocating rod is provided in a retreat flow path for connecting a fluid source and a supply/discharge port that supplies and discharges fluid to and from the retreat pressure chamber.

4. The fluid pressure cylinder according to claim 3, wherein the communication path is formed in the fastening cylinder, the supply/discharge port is provided in the case main body, and the release pressure chamber and the retreat pressure chamber are communicated via the case main body.

5. The fluid pressure cylinder according to claim 4, wherein a throttle for exerting a resisting force on fluid flowing from the case main body into the retreat pressure chamber is provided in a cover partitioning the case main body and the driving cylinder.

6. The fluid pressure cylinder according to claim 4, wherein a fastening pressure chamber for applying pressure in a fastening direction to the fastening piston is formed in the fastening cylinder and a supply/discharge port communicating with the fastening pressure chamber is formed, and a valve member for making the supply/discharge port and the fastening pressure chamber communicate with each other when the fastening rod moves a predetermined stroke in the fastening direction is mounted in the fastening rod.

7. The fluid pressure cylinder according to claim 1, wherein a throttle for generating back pressure in the advance pressure chamber at a time of a retreat movement of the reciprocating rod is provided in an forward flow path for connecting a fluid source and a supply/discharge port that supplies and discharges fluid to and from the advance pressure chamber.

* * * * *